United States Patent [19]

Mochizuki

[11] Patent Number: 4,863,391

[45] Date of Patent: Sep. 5, 1989

[54] CONTACT TERMINAL FOR HIGH VOLTAGE RESISTOR WIRE

[75] Inventor: Shigehiko Mochizuki, Shizuoka, Japan

[73] Assignee: Yazaki Corporation, Tokyo, Japan

[21] Appl. No.: 204,535

[22] Filed: Jun. 9, 1988

[30] Foreign Application Priority Data

Jun. 25, 1987 [JP] Japan ..... 62-96506
Nov. 10, 1987 [JP] Japan ..... 62-170708

[51] Int. Cl.[4] ..... H01R 4/18
[52] U.S. Cl. ..... 439/125; 439/867
[58] Field of Search ..... 439/125–128, 439/865–868, 877–882; 174/84 C

[56] References Cited

U.S. PATENT DOCUMENTS

| | | | |
|---|---|---|---|
| 2,794,964 | 6/1957 | Hoffman | 439/877 |
| 4,032,215 | 6/1977 | Jarmofsky et al. | 439/877 |
| 4,184,736 | 1/1980 | Spaulding | 439/879 |
| 4,272,150 | 6/1981 | Fairbairn | 439/879 |

FOREIGN PATENT DOCUMENTS

| | | | |
|---|---|---|---|
| 0026117 | 4/1981 | European Pat. Off. . | |
| 600374 | 2/1926 | France | 439/877 |
| 52-12879 | 1/1977 | Japan . | |
| 60-64580 | 5/1985 | Japan . | |
| 621949 | 4/1949 | United Kingdom | 439/879 |
| 2002185 | 2/1979 | United Kingdom . | |

*Primary Examiner*—Gary F. Paumen
*Attorney, Agent, or Firm*—Robbins & Laramie

[57] ABSTRACT

A contact terminal is disclosed which comprises a terminal portion of a high voltage resistor wire and an engagement portion formed integrally with a gripper portion for engaging an electrode of a spark plug or the like. A pressure contact tab is integrally formed in an intermediate portion between the gripper portion and the engagement portion. The pressure contact tab may be bent at a right angle relative to an axis of the terminal.

4 Claims, 5 Drawing Sheets

CONTACT TERMINAL FOR HIGH VOLTAGE RESISTOR WIRE

BACKGROUND OF THE INVENTION

1. Field of the Invention

The present invention relates to an improvement for enhancing the mechanical strength of a contact terminal used at a terminal portion of a high voltage resistor wire to be connected to a spark plug, a distributor or the like of automotive vehicles.

2. Description of the Prior Art

A contact terminal to be used for terminal connection for a high voltage resistor wire is proposed in Japanese Utility Model Unexamined Publication No. 52-12879. The contact terminal shown in that publication is so constructed that there is provided a cut and raised tab extending from a base plate and located between grippers for the electric wire and an engagement portion engaged with an electrode of a spark plug, a distributor or the like. The electric wire is fixed in contact with the grippers such that a folded-back bend of core wire, from which an insulative coating has been removed at a terminal portion of the electric wire, is brought into pressing contact with the cut and raised tab.

In the thus constructed contact terminal, since the cut and raised tab is formed in an intermediate portion of the terminal base plate, the base plate has a corresponding hole that reduces the mechanical strength of the terminal such that the terminal would be subject to deformation.

Also, even though the contact terminal is in the straight form, since the area of the intermediate portion is small, the mechanical strength would be reduced. In particular, in the case where the intermediate portion is bent in an L-shape, it would be impossible to form the hole in a circular shape. As a result, the area of the bent portion is decreased thereby reducing the mechanical strength. This has long been a problem.

Furthermore, since the size of the raised and cut tab is restricted, there is a disadvantage in that the folded-back bend of the wire to be connected would be offset from the cut and raised tab, resulting in insufficient conduction or contact.

SUMMARY OF THE INVENTION

In order to overcome the above-noted defects inherent in the prior art, a primary object of the invention is to provide a contact terminal for a high voltage resistor wire, which eliminates a fear of the reduction in mechanical strength of the contact terminal and ensures a stable electric contact.

According to the present invention, there is provided a contact terminal comprising a gripper portion for contacting and fastening a terminal portion of a high voltage resistor wire and an engagement portion formed integrally with the gripper portion for engaging an electrode of a spark plug or the like, wherein a pressure contact tab is integrally formed in an intermediate portion between the gripper portion and the engagement portion and the pressure contact tab may be bent at a right angle relative to an axis of the contact material.

Also, according to the present invention, a projection for supporting the pressure contact tab is formed by cutting and raising the projection from a bottom wall of the gripper portion.

According to the invention, a claw for supporting the pressure contact tab is formed on a projection from a rear edge of the gripper portion.

According to another aspect of the invention, the pressure contact tab is integrally formed through a reinforcement tab in the intermediate portion between the gripper portion and the engagement portion so that the reinforcement tab may be bent so as to overlap with the intermediate portion and the pressure contact tab may be bent at a right angle relative to the axis of the contact terminal.

Also, according to the present invention, the projection for supporting the pressure contact tab is formed in the reinforcement tab formed in the intermediate portion having the pressure contact tab integrally between the gripper portion and the engagement portion.

DETAILED DESCRIPTION OF THE INVENTION

Figure 10:
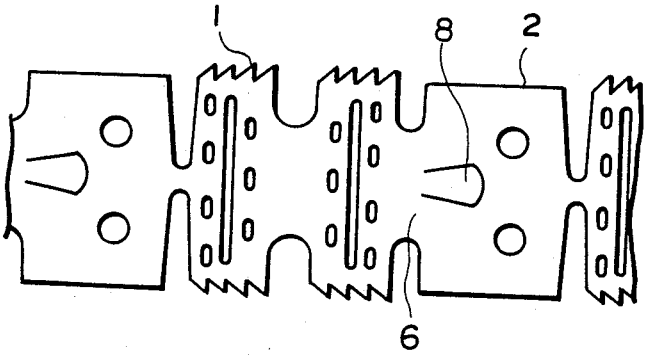
Fig. 10 PRIOR ART
FIG. 10 is a plan view showing a conventional contact terminal blank.
Figure 11:
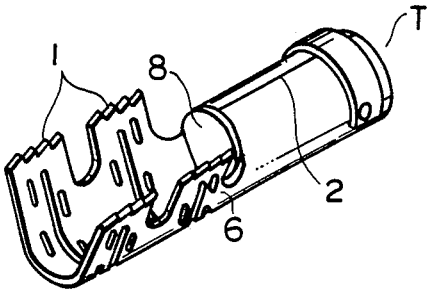
Fig. 11 PRIOR ART
FIG. 11 is a perspective view showing the conventional contact terminal.
Figure 12:
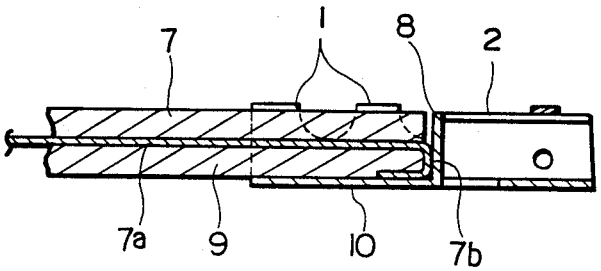
Fig. 12 PRIOR ART
FIG. 12 is a cross-sectional view showing the connection between the conventional contact terminal and the high voltage resistor wire.

In FIGS. 10, 11 and 12 showing the prior art described in the above-described Japanese Patent Unexamined Publication No. 52-12879, a cut and raised tab 8 extending from a base plate is formed between a gripper portion 1 for the electric wire 7 and an engagement portion 2 to be engaged with an electrode of a spark plug, a distributor or the like. The electric wire 7 is pressingly fixed to the gripper portion 1 whereby a folded-back bend 7*b*, of a core wire 7*a* from which an insulator coating 9 at the terminal portion of the wire 7 has been removed, is brought into pressing contact with the cut and raised tab 8. The defects inherent to this structure have already been described.

As described above, even though the thus constructed contact terminal T is in the striaght form, the area of the intermediate portion 6 is small and thereby reduces the mechanical strength. In particular in the case where the intermediate portion 6 is bent in an L-shape, it is impossible to form the hole for the tab 8 in a circular shape. This results in a decrease in the area of the bent portion thereby reducing the mechanical strength.

Embodiments of the invention will now be described with reference to FIGS. 1 to 5.

A gripper portion 1 is used to fix under pressure a terminal portion of a high voltage resistor wire 7 to the contact terminal. An engagement portion 2 is engaged with a conductor of an electric part. A pressure contact tab 3 formed integrally with a rear eege of the engagement portion 2 is bent between the gripper portion 1 and the engagement portion 2 to be located substantially at a right angle relative to an axial direction of the contact terminal T.

Figure 4:
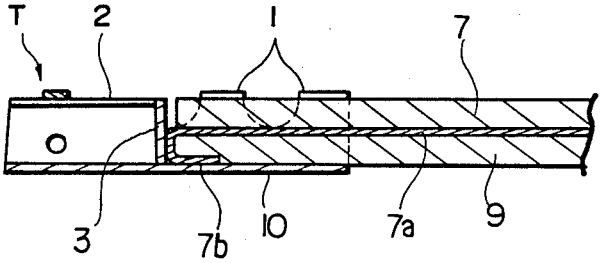
FIG. 4 is a cross-sectional view showing a terminal structure of a high voltage resistor wire according to one embodiment of the invention.

As shown in FIG. 4, a folded-back *7b*, of a core wire *7a* from which an insulator coating 9 has been removed at a terminal portion of the high voltage resistor wire 7, is held in pressing contact with the pressure contact tab 3. Under this condition, the high voltage resistor wire and the contact terminal T are fixed to each other by the gipper portion 1.

Figure 1:
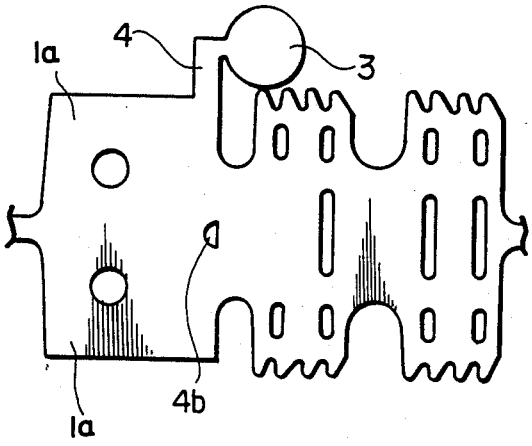
FIG. 1 is a plan view showing a contact terminal blank according to the present invention.
Figure 2:
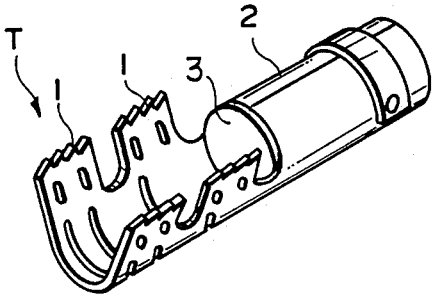
FIG. 2 is a perspective view showing the contact terminal according to the invention.
Figure 3:
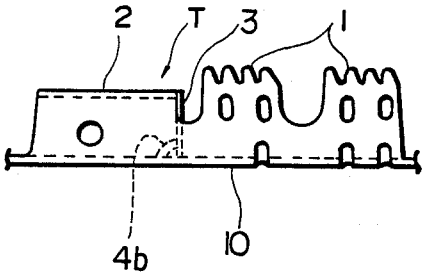
FIG. 3 is a side elevational view of the contact terminal shown in FIG. 2.

The pressure contact tab 3 is integrally formed through a connecting portion 4 with a gripper 1*a* as shwon in a developed view of FIG. 1. The pressure contact tab 3 is sized so that it may just fit in an internal space defined by bending of a pair of grippers 1*a*. In other words, it is preferable that the pressure contact tab 3 be sized so as to essentially close the internal spaced defined by the bent grippers 1*a*.

It is also preferable that a projection 4*b* for supporting the pressure contact tab 3 be formed by cutting in a bottom wall 10. The projection 4*b* is used for preventing the pressure contact tab 3 from bending or deforming due to the pressure from the folded-back bend *7b*.

Figure 5:
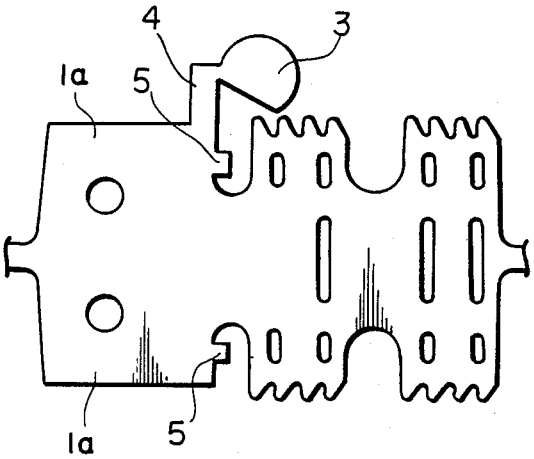
FIG. 5 is a plan view showing a contact terminal blank in accordance with another embodiment.

FIG. 5 shows another embodiment of the invention, in which, instead of the provision of the projection 4*b* in the bottom wall 10 of the base plate, claws 5 are formed at the rear edge of the grippers 1*a* and are bent inwardly during the formation of the terminal.

With the thus constructed contact terminal, as shown in FIG. 4, the connection between the contact terminal T and the high voltage resistor wire 7 is performed by firmly depressing the folded-back bend *7b* of the core wire *7a* against the pressure contact tab 3 and by fixing under pressure the insulator coating portion to the gripper portion 1 so that the bend *7b* is in confronting relation with the bottom wall 10 of the base plate. Namely, the core wire *7a* is in intimate contact with an inner surface of the gripper portion 1 and with the pressure contact tab 3 so that a desired electric connection is ensured.

In addition, since the pressure contact tab 3 is formed by utilizing the gripper portion 1 independently of the bottom wall 10, there is no fear that the mechanical strength of the contact terminal would be reduced.

Figure 6:
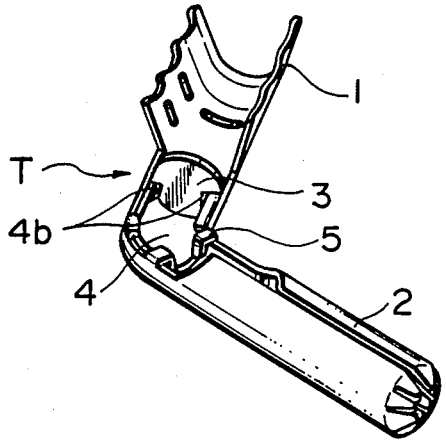
FIG. 6 is a perspective view showing a contact terminal in accordance with still another embodiment of the invention.
Figure 7:
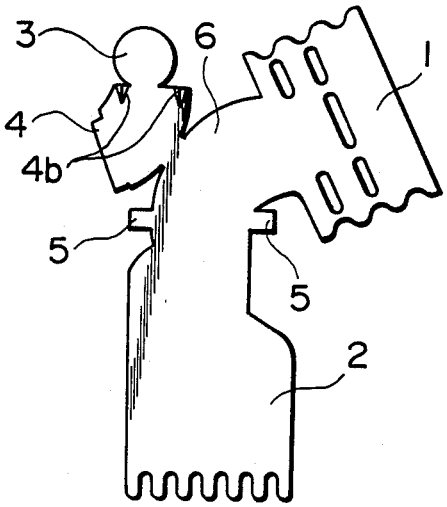
FIG. 7 is a plan view of the contact terminal blank shown in FIG. 6.

FIG. 6 is a perspective view showing a contact terminal T bent in an L-shape. FIG. 7 is a plan view of a blank of the terminal shown in FIG. 6. In FIGS. 6 and 7, reference numeral 1 denotes a gripper portion to be fixed under pressure to a terminal portion of a high voltage resistor wire, and reference numeral 2 denotes an associated engagement portion to be engaged with an electrode of a spark plug or the like. Reference numeral 3 denotes a pressure contact tab to be pressingly contacted with a core wire of the high voltage resistor wire, and reference numeral 4 denotes a large-size connecting tab, i.e., reinforcement tab integrally formed with the contact terminal T. The pressure contact tab 3 and the reinforcement tab 4 used as the connecting tab are connected integrally to each other. If desired, a projection 4*b* is formed by forming and projecting a part of the reinforcement tab 4 in a triangular shape. Claws 5 are used for fixing the reinforcement tab 4 to the contact terminal T. Reference numeral 6 denotes an intermediate portion between the gripper portion 1 and the engagement portion 2.

A preform that is cut from a thin metal plate made of a material such as stainless steel as shown in FIG. 7 is further formed so that the gripper portion 1 is in the form of a horseshoe and the engagement portion 2 is in the form of a cylinder by pressing. Also, the intermediate portion 6 is bent corresponding to these portions. Thus, the contact terminal T is formed as shown in FIG. 6. At this time, the reinforcement tab 4 is bent so as to overlap with the intermediate portion 6 and is fixed thereto by the claws 5 to thereby reinforce the intermediate portion which would be difficult to reinforce in accordance with the prior art.

The contact tab 3 is located substantially at a right angle relative to the axial direction of the contact terminal in the vicinity of the rear edge of the gripper portion 1 by bending the connecting portion to the reinforcement tab or connecting tab 4. Since the pressure contact tab 3 is not raised and cut from the base plate of the terminal, it is possible to set the size thereof as desired. If the tab is sized so as to essentially close the internal space defined by the gripper portion 1 during the pressing operation, it is possible to eliminate a fear that the bend *7b* of the core wire would be offset as in the conventional structure, and it is possible to eliminate the insufficient connection.

Figure 8:
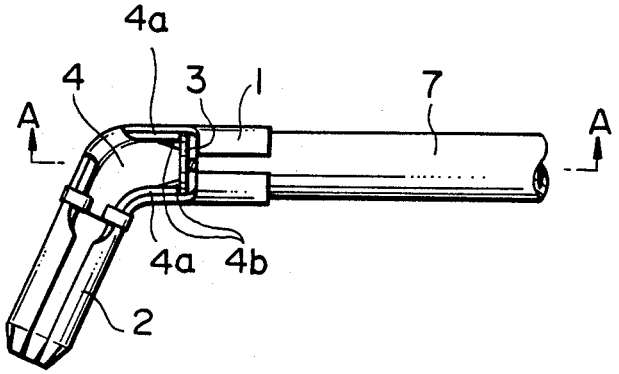
FIG. 8 is a front view showing a connection between the high voltage resistor wire and the contact terminal according to the invention.
Figure 9:
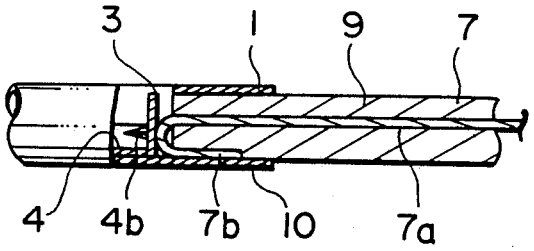
FIG. 9 is a cross-sectional view taken along the line A—A of FIG. 8.

FIGS. 8 and 9 show the connection state between the contact terminal and the high voltage resistor wire. As shown in FIG. 8, the contact terminal 3 is positioned at end faces, toward the gripper portion 1, of the raised portions 4*a* of the reinforcement tab 4. Also, the projection 4*b* is formed in advance so as to come substantially in contact with the pressure contact tab 3. The end portion of the high voltage resistor wire 7 is removed of the insulator coating 9 to expose the core wire *7a* and is bent in a U-shape to form a bend *7b*. The core wire *7a* is fixed to the gripper portion 1 under the condition that the core wire 7 is kept under pressure and in contact with both the gripper portion 1 and the pressure contact portion 3. The fixing operation causes the insulator coating 9 to extend slightly toward the pressure contact tab 3 so that the bend *7b* of the core wire 7 is strongly contacted against the pressure contact tab 3. By receiving the pressure contact tab with the end faces of the raised portions 4*a* and/or providing the projection 4*b*, it is possible to support the pressure contact tab 3 without any tilt, due to the contact force from the high voltage resistor wire side. Thus, the core wire *7a* is brought into contact with the inner surface of the gripper portion 1 and the pressure contact portion 3 to achieve a desired electrical connection state.

Also, the integral portion of the reinforcement tab, i.e., connecting tab 4 is not limited to the structure in which the reinforcement tab 4 is formed integrally with the contact terminal body T as shown in FIG. 7. The reinforcement tab 4 may be formed of a separate and independent member and be fixed by fastening means such as claws 5 during the terminal formation.

As described above, according to the present invention, a connecting tab, i.e., reinforcement tab, is formed in an intermediate portion between the gripper portion and the engagement portion of the contact terminal. The reinforcement tab is bent and fixed along with the configuration of the intermediate portion of the terminal, and at the same time, the pressure contact tab is bent in the vicinity of the edge portion of the gripper portion so that the pressure contact tab is located substantially at a right angle relative to the axial direction of the terminal. Thus, the mechanical strength of the intermediate portion between the gripper portion and the engagement portion is not reduced.

Also, there is no restriction to the size of the pressure contact tab. It is possible to prevent the core wire from being offset out of the pressure contact tab, to ensure the desired electrical connection.

What is claimed is:

1. A contact terminal comprising:

a gripper portion for contacting and fastening a terminal portion of a high voltage resistor wire;

an engagement portion formed integrally with said gripper portion for engaging an electrode of an electrical device such as a spark plug;

an intermediate portion of said terminal between said gripper portion and said engagement portion;

a pressure contact tab integrally formed with said intermediate portion at a rear edge of said gripper portion, said pressure contact tab being bent at a right angle relative to the longitudinal axis of the contact terminal; and a projection for supporting said pressure contact tab and for preventing movement of said tab towards said engagement portion, said prjection being formed by cutting and raising the projection from a bottom wall of said intermediate portion.

2. A contact terminal comprising:

a gripper portion for contacting and fastening a terminal portion of a high voltage resistor wire;

an engagement portion formed integrally with said gripper portion for engaging an electrode of an electrical device such as a spark plug;

an intermediate portion of said terminal between said gripper portion and said engagement portion;

a pressure contact tab integrally formed with said intermediate portion at a rear edge of said gripper portion, said pressure contact tab being bent at a right angle relative to an axis of the contact terminal; and at least one claw for supporting the pressure contact tab and for preventing movement of said tab towards said engagement portion, said claw being formed from a projection extending from a rear edge of the gripper portion.

3. A contact terminal comprising:

a gripper portion for contacting and fastening a terminal portion of a high voltage resistor wire;

an engagement portion formed integrally with said gripper portion for engaging an electrode of an electrical device such as a spark plug;

an intermediate portion of said terminal between said gripper portion and said engagement portion;

a pressure contact tab integrally formed with said intermediate portion, said pressure contact tab being bendable at a right angle relative to an axis of the contact terminal; and a reinforcement tab integrally formed with said pressure contact tab, said reinforcement tab being bent so as to overlap a substantial portion of said intermediate portion.

4. The contact terminal of claim 3, wherein a projection for supporting said pressure contact tab is formed in said reinforcement tab.

* * * * *